US008037817B2

(12) United States Patent
Tonosu et al.

(10) Patent No.: US 8,037,817 B2
(45) Date of Patent: Oct. 18, 2011

(54) LIQUID COATING MACHINE WITH PLATE REPLACING WORK SPACE

(75) Inventors: Toyoo Tonosu, Tokyo (JP); Isao Komuro, Noda (JP); Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 403 days.

(21) Appl. No.: 12/332,986

(22) Filed: Dec. 11, 2008

(65) Prior Publication Data

US 2009/0165660 A1 Jul. 2, 2009

(30) Foreign Application Priority Data

Dec. 28, 2007 (JP) ..... 2007-339309

(51) Int. Cl.
*B41F 9/18* (2006.01)
*B41L 13/04* (2006.01)

(52) U.S. Cl. ..... 101/216; 101/116; 101/153; 101/479

(58) Field of Classification Search ..... 101/479, 101/480, 477, 116, 216, 153
See application file for complete search history.

(56) References Cited

U.S. PATENT DOCUMENTS

| | | | | |
|---|---|---|---|---|
| 2,585,325 | A * | 2/1952 | Imshaug | 414/746.8 |
| 4,572,069 | A * | 2/1986 | Schwarzbeck | 101/76 |
| 5,632,202 | A * | 5/1997 | Robesin et al. | 101/216 |
| 5,794,531 | A * | 8/1998 | Keller | 101/479 |
| 6,202,554 | B1 * | 3/2001 | Kamoda | 101/153 |
| 7,040,224 | B2 * | 5/2006 | Eura | 101/216 |

* cited by examiner

*Primary Examiner* — Leslie J Evanisko
(74) *Attorney, Agent, or Firm* — Birch, Stewart, Kolasch & Birch, LLP

(57) ABSTRACT

A rotary screen printing press, which includes a rotary screen cylinder for coating ink on a sheet transported by transport means, and a plate or form replacing work space whose upper side is closed, with respect to which a transport direction of the sheet is restrained by other device and a liquid coating unit including the rotary screen cylinder, which is open in at least one of directions orthogonal to the transport direction of the sheet, and where an operator performs work of replacing a screen printing form, comprises a plate or form rest provided below the rotary screen cylinder and supported to be movable to a first position within the liquid coating unit and a second position within the form replacing work space.

6 Claims, 6 Drawing Sheets

LIQUID COATING MACHINE WITH PLATE REPLACING WORK SPACE

BACKGROUND OF THE INVENTION

1. Field of the Invention

This invention relates to a liquid coating machine of a rotary screen printing press or the like.

2. Description of the Related Art

In screen printing by a rotary screen printing press, ink is placed in a screen printing forme, and the screen printing forme is pressed against paper by a squeegee or a doctor roller to transfer the ink to a printing surface of the paper through the openings of the screen printing forme. The screen printing forme needs to be replaced each time a different printing product is to be printed.

The work of replacing the screen printing forme will be described, for example, in connection with an intaglio and rotary screen printing press as shown in FIG. 6.

In this printing press (liquid coating machine), sheets of paper (sheets, for short) W are fed one by one from a feeder 10 onto a feedboard 11. Then, the sheet W is passed from a swing arm shaft pregripper 12 on to a transfer cylinder 13, and then gripped by grippers 14*a* of an impression cylinder 14 for the purpose of transport (transport means). On the other hand, conventional inks are supplied from within ink fountains 20 to chablon rollers 17 via ink fountain rollers 19 and intermediate rollers 18, and supplied to an ink collecting cylinder 16 (other device). Then, the inks are collectively supplied to an intaglio plate of a plate cylinder 15. Also, special ink is directly supplied, in a constant amount in a predetermined pattern, from within a rotary screen cylinder (stencil printing cylinder) 22 to the intaglio plate of the plate cylinder 15 via a rubber roller 21 (liquid coating unit).

These inks have their surplus amounts removed by a wiping roller 23, and are then transferred to the sheet W passed on to the impression cylinder 14 for the purpose of printing. The printed sheet W is transported and delivered by a delivery chain 26 via a delivery cylinder 25.

In such a rotary screen printing press, when the screen printing forme (stencil printing plate) of the rotary screen cylinder 22 is to be replaced, it has been common practice for two operators to hold opposite end portions of the screen printing forme in places near entrances 28 to the machine. This is because a forme or plate replacing work space S for replacing the screen printing forme of the rotary screen cylinder 22 has its upper side closed with a printing unit or a transport unit for the sheet W, and has its fore-and-aft direction restrained by other printing devices. Thus, the space S is only a narrow space defined by these printing devices. Moreover, the machine entrances 28 formed on both sides of a machine frame 27 are narrow. These situations make it difficult for one operator to do replacing work while holding the screen printing forme.

Thus, the two operators have to do the work in a well-coordinated manner with an unnatural posture, thus posing the problems of decreasing the operators' work efficiency and imposing a burden on the operators.

SUMMARY OF THE INVENTION

The present invention has been proposed in light of the above-described problems. It is an object of the invention to provide a liquid coating machine by which only one operator is required to do the work of replacing a stencil printing plate with ease.

An aspect of the present invention is a liquid coating machine including transport means for transporting a sheet, a stencil printing cylinder, provided below the transport means, for coating a liquid on the sheet transported by the transport means, and a plate replacing work space whose upper side is closed, with respect to which a transport direction of the sheet is restrained by other device and a liquid coating unit including the stencil printing cylinder, which is open in at least one of directions orthogonal to the transport direction of the sheet, and where an operator performs work of replacing a stencil printing plate, the liquid coating machine comprising a plate rest provided below the stencil printing cylinder and supported to be movable to a first position within the liquid coating unit and a second position within the plate replacing work space.

The plate rest may be supported by a horizontal movement guide member to be movable to the first position and the second position.

A rolling body may be provided on a surface on a side of the plate rest supporting the stencil printing plate, and the stencil printing plate may be supported via the rolling body.

The liquid coating machine may further comprise a four-joint link for supporting the plate rest, and drive means for swinging the four-joint link, and the plate rest may be moved to the first position and the second position by the drive means via the four-joint link.

An ink pan may be supported by the plate rest, and the stencil printing plate may be supported by the plate rest via the ink pan.

A pair of plate bearers having inclined surfaces opposing each other may be integrally formed on an upper surface of the ink pan, and the stencil printing plate may be supported on the inclined surfaces of the plate bearers.

A pair of plate bearers having a plurality of rolling bodies annexed thereto may be integrally formed on an upper surface of the ink pan, and the stencil printing plate may be supported by the rolling bodies of the plate bearers.

The plate rest may be moved to reciprocate between the first position and the second position during the work of replacing the plate.

According to the liquid coating machine concerned with the present invention, one operator is enough to perform the work of replacing the stencil printing plate easily, by using the plate rest, while avoiding the expansion of the plate replacing work space or the machine entrance of the frame.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A liquid coating machine according to the present invention will be described in detail by embodiments with reference to the accompanying drawings.

Embodiment 1

Figure 1:
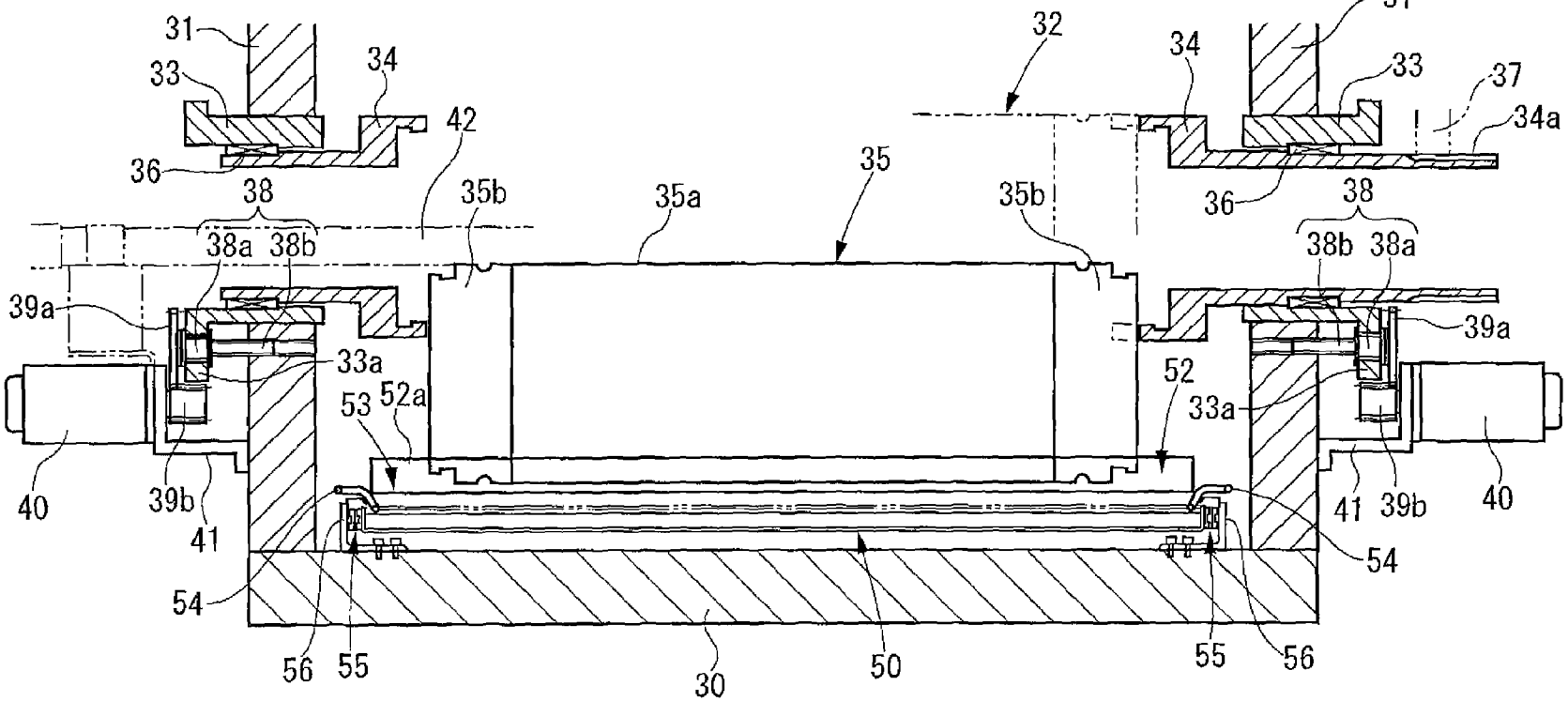
FIG. 1 is a schematic configurational sectional view of a rotary screen printing unit in a rotary screen printing press showing Embodiment 1 of the present invention.
Figure 2:
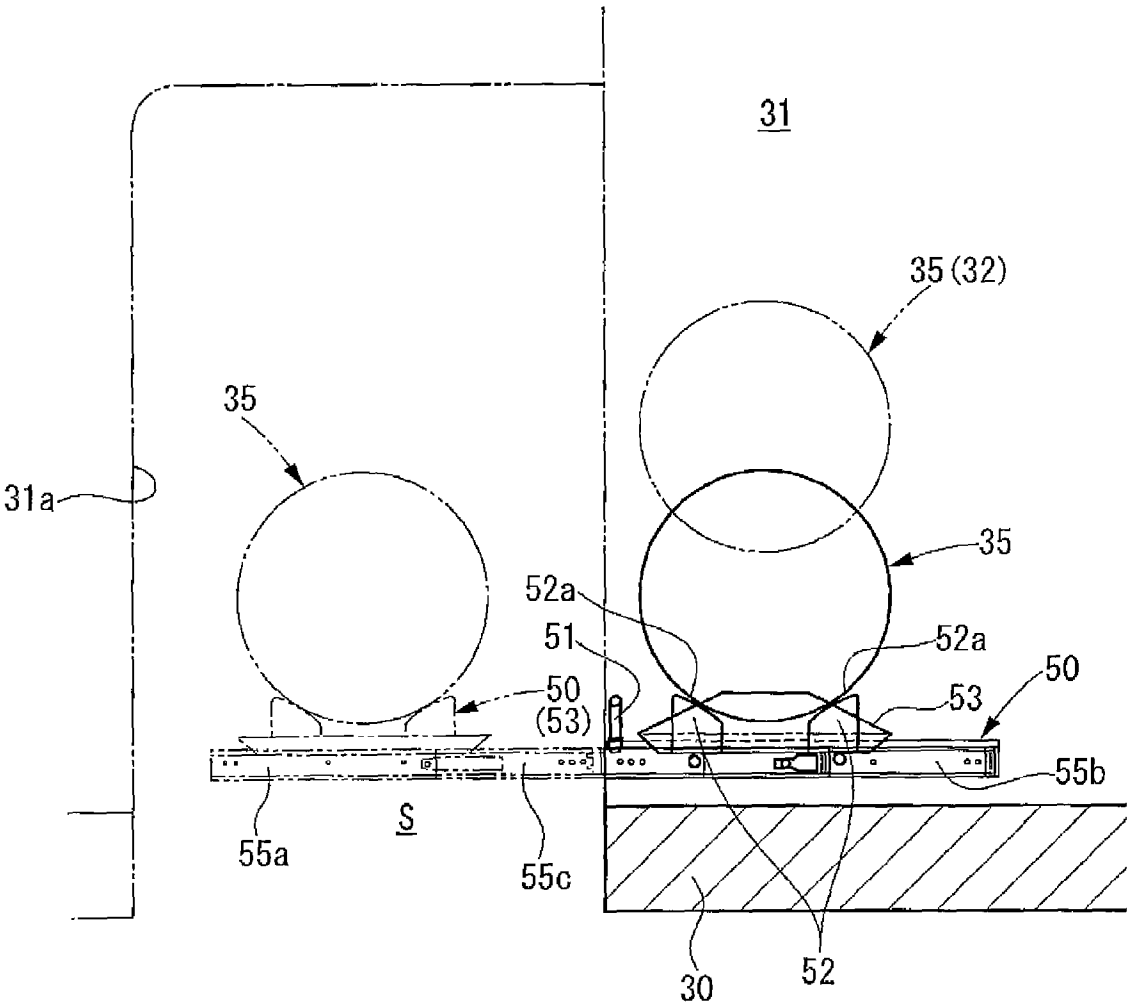
FIG. 2 is a schematic right side view of the rotary screen printing unit in FIG. 1.
Figure 3:
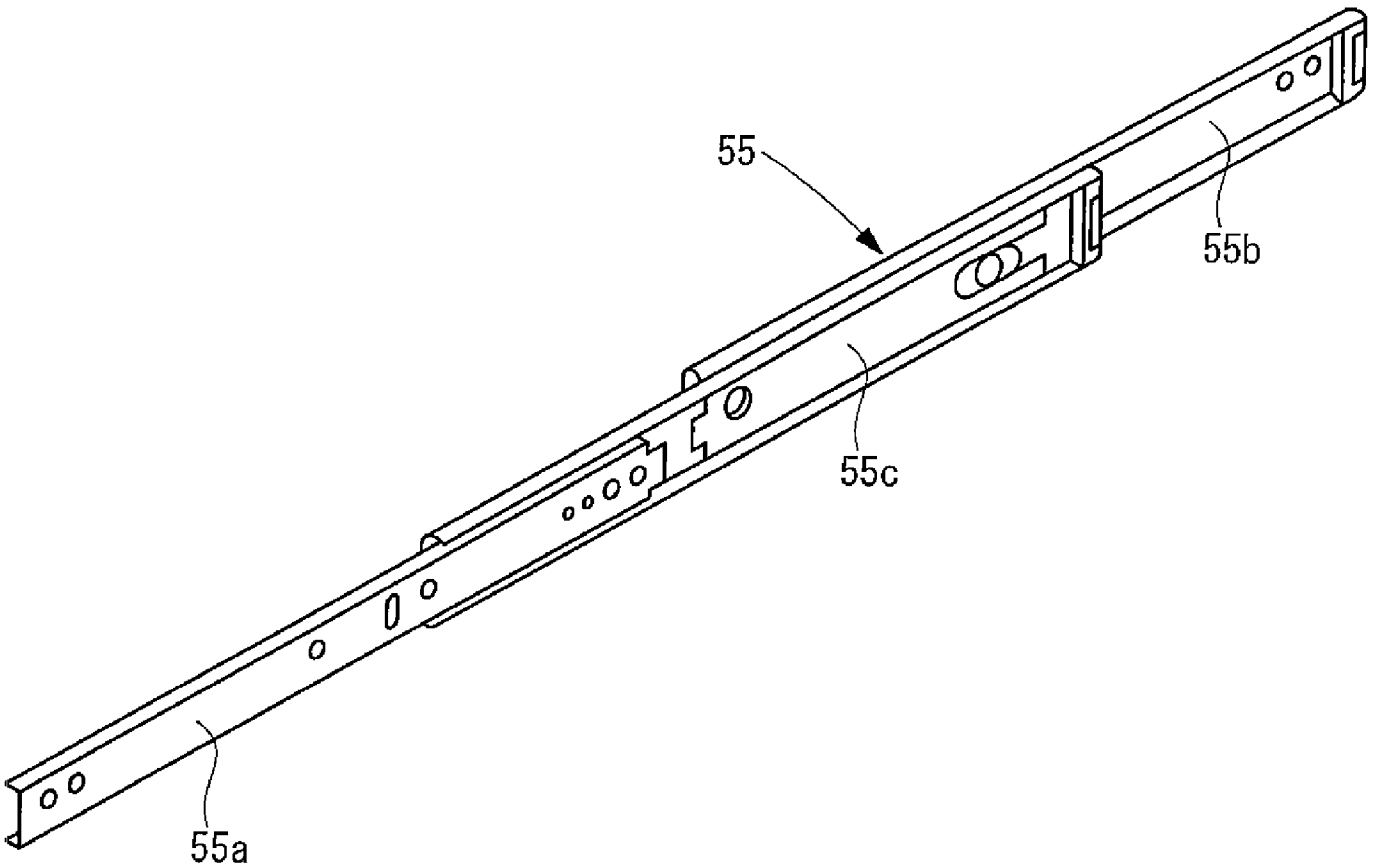
FIG. 3 is a perspective view of a slide rail.

FIG. 1 is a schematic configurational sectional view of a rotary screen printing unit in a rotary screen printing press showing Embodiment 1 of the present invention. FIG. 2 is a schematic right side view of the rotary screen printing unit in FIG. 1. FIG. 3 is a perspective view of a slide rail.

In a rotary screen printing unit in a rotary screen printing press (liquid coating machine), as shown in FIG. 1, a rotary screen cylinder (stencil printing cylinder) 32 is supported between right and left frames 31 erected on a bed 30 via eccentric bearings 33 to be capable of throw-on and throw-off with respect to a rubber roller, an impression cylinder, etc. (not shown). The right and left eccentric bearings 33 are supported by the right and left frames 31 to be pivotable and slidable in the lateral direction (axial direction).

The rotary screen cylinder 32 comprises a cylindrical screen printing forme (stencil printing plate) 35 supported between right and left tubular end members 34, and in small-diameter parts of the right and left tubular end members 34, is also supported by the eccentric bearings 33 to be rotatable via bearings 36. The screen printing forme 35 comprises a mesh-shaped body portion 35*a*, and tubular mounting members 35*b* attached to the opposite ends of the body portion 35*a*.

A toothing 34*a* is engraved in the outer periphery of the small-diameter part of the right tubular end member 34, and a gear 37 meshes with the toothing 34*a*. Thus, the rotary screen cylinder 32 is rotationally driven, and can be circumferentially registered, by a motor (not shown) via the above-mentioned gear mechanism.

In a slot formed in a flange portion 33*a* of each of the right and left eccentric bearings 33, a head 38*a* of a bolt 38 is fitted to be rotatable and movable in the major-diameter direction of the slot, but immovable in the axial direction of the slot A threaded portion 38*b* of the bolt 38 is screwed into a threaded bore of the frame 31. A gear 39*a* is secured to each of the heads 38*a* of the right and left bolts 38, and a gear 39*b* secured onto an output shaft of a motor 40 meshes with each of the gears 39*a*. The right and left motors 40 are mounted on support brackets 41 bound to the right and left frames 31.

Thus, the right and left eccentric bearings 33 are slid in the lateral direction (axial direction) by the motor 40 via the aforementioned gear mechanism and feed screw mechanism to permit the tension adjustment of the screen printing forme 35 and the movement of the bearings during removal of the screen printing forme 35.

A pipe-shaped support shaft 42 closed at a right end is inserted through the rotary screen cylinder 32, and a rubber squeegee (not shown) is supported by the support shaft 42. The leading end of this squeegee makes sliding contact with the inner peripheral surface of the screen printing forme 35 (body portion 35*a*) Thus, the ink (liquid) supplied through the interior of the support shaft 42 into the screen printing forme 35 is transferred onto a printing surface of the sheet via the openings of the body portion 35*a*.

In the present embodiment, as shown in FIG. 2 as well, a quadrilateral frame-shaped forme or plate rest 50 having a withdrawing grip 51 annexed to each of right and left front parts thereof is disposed on the bed 30, which is located below the rotary screen cylinder 32 in the assembled state, via slide rails 55 and angle members 56 to be described later.

An ink pan 53, which receives ink dripping from the screen printing forme 35 of the rotary screen cylinder 32 during printing and during stoppage of printing, is placed on the forme rest 50. A pair of (i.e., front and rear) forme or plate bearers 52 having inclined surfaces 52*a* opposing each other are formed integrally with the ink pan 53. A pull-out grip 54 is annexed to each of right and left parts of the ink pan 53 (the pull-out grip 54 may be provided at one of the right and left parts corresponding to one of machine entrances 31*a* to be described later).

The forme rest 50 is supported by the right and left (paired) slide rails (horizontal movement guide members) 55 to be movable from the aforementioned position (a first position within the liquid coating unit, as indicated by solid lines in FIG. 2) to a second position (a position indicated by dashed double-dotted lines in FIG. 2) within a forme or plate replacing work space S which an operator can go into and out of through the machine entrance 31*a* formed in at least one of the right and left frames 31.

The slide rail 55, as shown in FIG. 3, comprises a moving rail 55*a*, a stationary rail 55*b*, and an intermediate rail 55*c* slidably fitted to both of the moving rail 55*a* and the stationary rail 55*b*. The moving rail 55*a* is fixed to the right and left parts of the forme rest 50, while the stationary rail 55*b* is fixed to the pair of (i.e., right and left) L-shaped angle members 56 laid in the fore-and-aft direction on the bed 30.

The slide rail 55 has a locking mechanism (not shown) for locking and unlocking in the most contracted state at the first position within the liquid coating unit, and in the most extended state at the second position within the forme replacing work space S.

Because of the above-described features, the following work procedure is performed in replacing the screen printing forme 35 for printing a different printing product:

(1) First of all, the operator enters the forme replacing work space S through the machine entrance 31*a*, and then while pressing the used screen printing forme 35, operates a switch for moving the tubular end members 34 at the opposite ends of the rotary screen cylinder 32 outwards by driving of the motors 40, thereby moving the tubular end members 34 outwards, and also detaching the used screen printing forme 35 from the tubular end members 34. Then, the operator places the used screen printing forme 35 on the inclined surfaces 52*a* of the forme bearers 52 of the ink pan 53 placed on the forme rest 50.

(2) Then, the operator grasps the withdrawing grips 51, and moves the forme rest 50, together with the ink pan 53, from the first position within the liquid coating unit toward the second position within the forme replacing work space S. During this movement, the operator goes out of the forme replacing work space S through the machine entrance 31*a*.

(3) Then, the operator removes the used screen printing forme 35 placed on the ink pan 53 on the forme rest 50 located at the second position within the forme replacing work space S. On this occasion, if the screen printing forme 35 is severely soiled, for example, the pull-out grips 54 may be grasped, and the screen printing forme 35 may be taken out of the machine together with the ink pan 53.

(4) Then, the operator places another screen printing forme 35, which is used in subsequent printing, on the inclined surface 52*a* of the forme bearers 52 of the ink pan 53 on the forme rest 50.

(5) Then, the operator grasps the withdrawing grips 51, and moves the forme rest 50, together with the ink pan 53, from the second position within the forme replacing work space S to the first position within the liquid coating unit.

(6) Finally, the operator enters the forme replacing work space S through the machine entrance 31*a*, and while pressing the screen printing forme 35 to be used in subsequent printing, operates a switch for moving the tubular end members 34 at the opposite ends of the rotary screen cylinder 32 inwards by driving of the motors 40, thereby moving the tubular end members 34 inwards, and also allowing the tubular end members 34 to support the screen printing forme 35 to be used in subsequent printing.

Since the screen printing forme 35 is replaced in the above-mentioned manner, one operator is enough to perform the work of replacing the screen printing forme 35 easily, by using the forme rest 50, even if the forme replacing work space S or the machine entrance 31*a* of the frame 31 is narrow, in other words, without the need to widen the space S or the entrance 31*a*. Moreover, the machine can be downsized.

Furthermore, since the ink pan 53 is present, it brings the advantages that it can serve as an ink receptacle if an ink scatter, for example, occurs during printing, and that it can be carried to a utility room without the need for holding a dirty screen printing forme 35 at the time of replacement. Of course, the ink pan 53 may be omitted.

In the present embodiment, the forme rest 50 may be automatically withdrawn by an air cylinder or the like, instead of being withdrawn by the withdrawing grips 51. Moreover, the horizontal movement guide member, such as a mere slide table, other than the slide rails 55, may be used.

Embodiment 2

Figure 4:
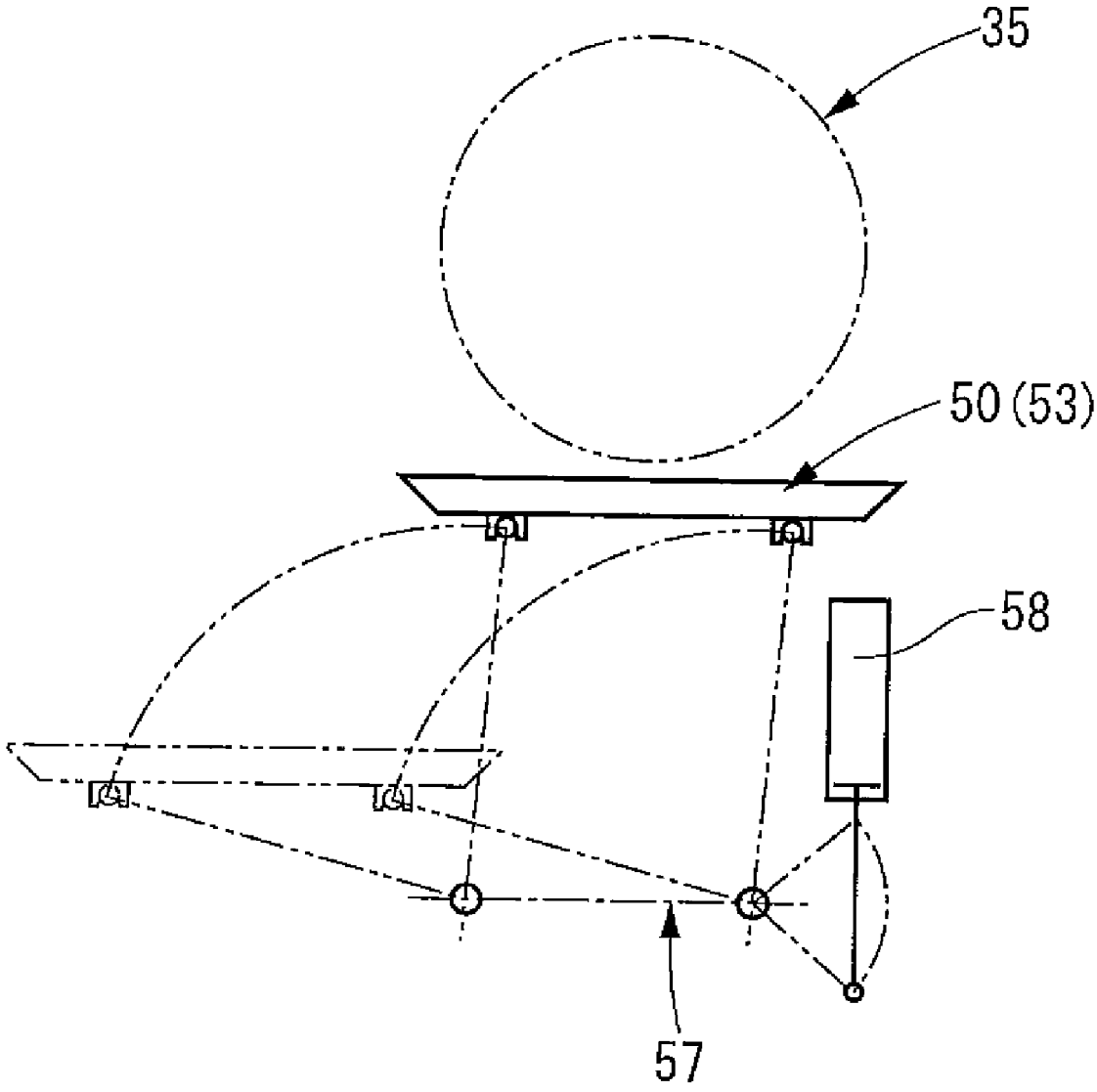
FIG. 4 is an explanation drawing using a four-joint link and drive means (air cylinder) showing Embodiment 2 of the present invention.

FIG. 4 is an explanation drawing using a four-joint link and a drive means (air cylinder) showing Embodiment 2 of the present invention.

This is an embodiment in which the forme rest 50 can be moved between the first position within the liquid coating unit and the second position within the forme replacing work space S by air cylinders (drive means) 58 via four-joint links 57 instead of the slide rails 55 as the horizontal movement guide members of Embodiment 1.

The above feature obtains the advantage that the replacing work can be performed more promptly, in addition to the same actions and effects as those in Embodiment 1.

In the present embodiment, it is possible to substitute the air cylinder 58 by a gas damper without using the air cylinder 58, attach an operating lever to the fulcrum, and provide a stopper at the position of attachment and detachment, thereby converting the mode of operation into a manual mode.

Embodiment 3

Figure 5A:
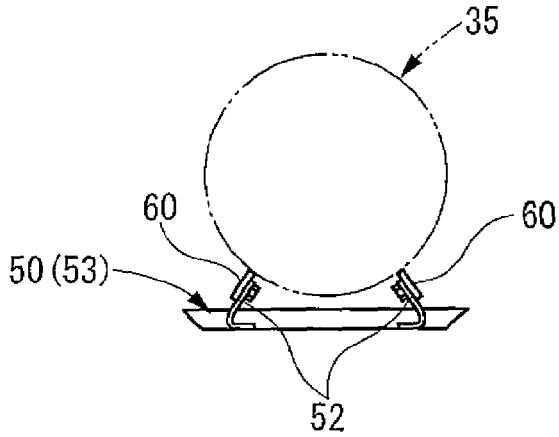
FIG. 5A is an explanation drawing using rolling bodies (rollers) showing Embodiment 3 of the present invention.
Figure 5B:
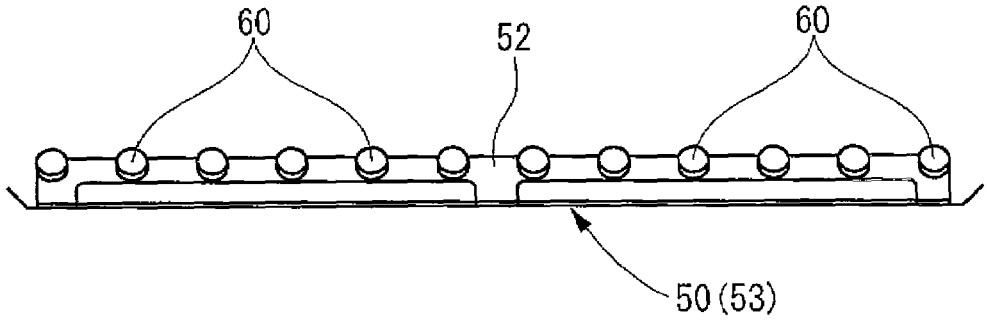
FIG. 5B is an explanation drawing using the rolling bodies (rollers) showing the Embodiment 3 of the present invention.
Figure 6:
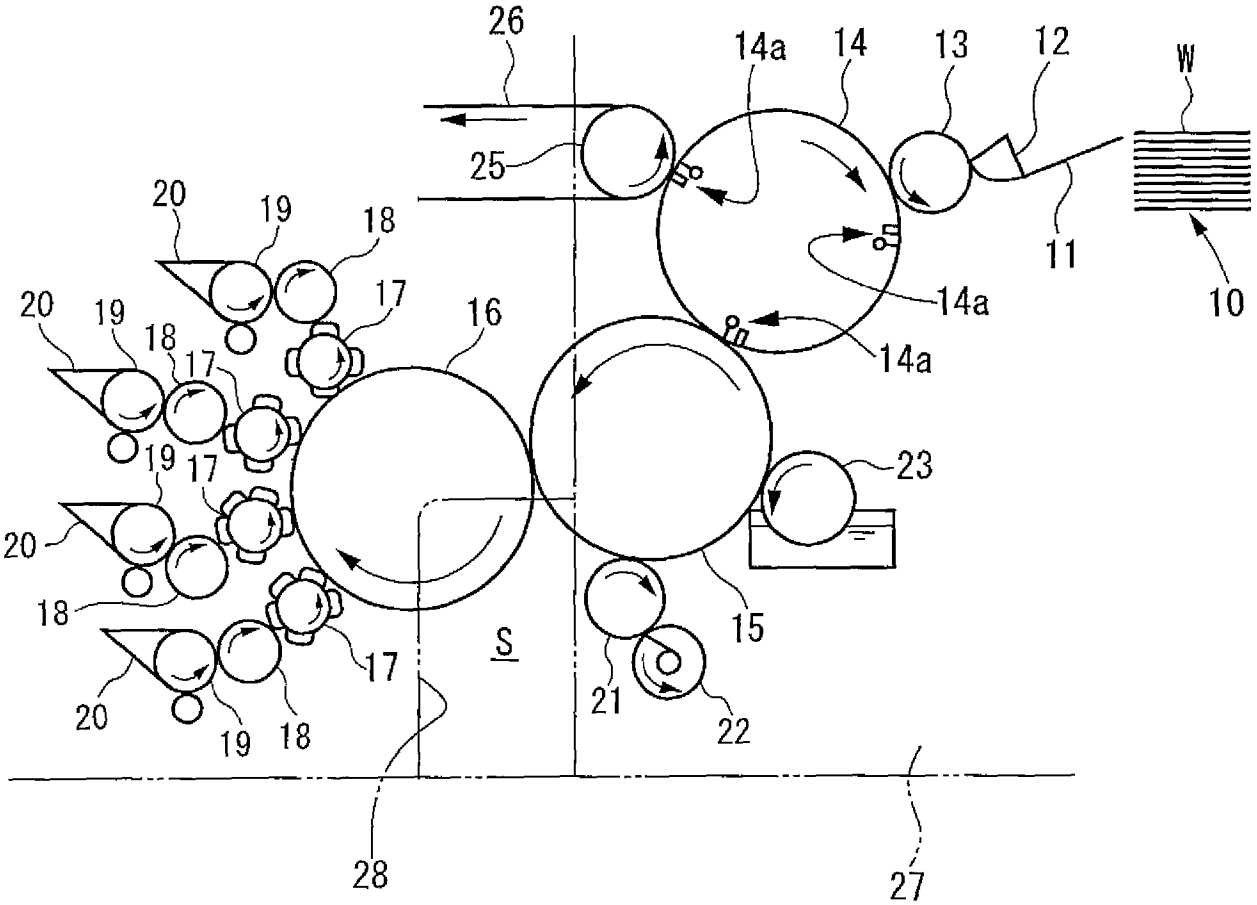
Fig.6 Related Art
FIG. 6 is a schematic configurational view of a conventional intaglio and rotary screen printing press.

FIGS. 5A and 5B are explanation drawings using rolling bodies (rollers) showing Embodiment 3 of the present invention.

This is an embodiment in which many rollers (rolling bodies) 60 are discretely arranged in the longitudinal direction on the forme bearers 52 of Embodiment 1.

The above feature obtains the advantage that the screen printing forme 35 can be easily withdrawn from and placed in the machine, in addition to the same actions and effects as those in Embodiment 1.

While the present invention has been described in the foregoing fashion, it is to be understood that the invention is not limited thereby, but may be varied in many other ways. For example, the present invention can be applied to machines other than the rotary screen printing press, such as a stencil printing press and a coating machine for supplying varnish instead of ink and performing coating instead of printing. Such variations are not to be regarded as a departure from the spirit and scope of the invention, and all such modifications as would be obvious to one skilled in the art are intended to be included within the scope of the appended claims.

What is claimed is:

1. A liquid coating machine, comprising:

transport means for transporting a sheet;

a stencil printing cylinder, provided below the transport means, for coating a liquid on the sheet transported by the transport means;

a plate replacing work space whose upper side is closed, with respect to which a transport direction of the sheet is restrained by another device and a liquid coating unit including the stencil printing cylinder, which is open in at least one direction to correct an obvious typographical error orthogonal to the transport direction of the sheet, and where an operator performs work of replacing a stencil printing plate; and a plate rest provided below the stencil printing cylinder and supported to be movable to a first position within the liquid coating unit and a second position within the plate replacing work space, wherein an ink pan is supported by the plate rest, and the stencil printing plate is supported by the plate rest via the ink pan.

2. The liquid coating machine according to claim 1, wherein the plate rest is supported by a horizontal movement guide member to be movable to the first position and the second position.

3. The liquid coating machine according to claim 1, wherein a rolling body is provided on a surface on a side of the plate rest supporting the stencil printing plate, and the stencil printing plate is supported via the rolling body.

4. The liquid coating machine according to claim 1, further comprising:

a four-joint link for supporting the plate rest; and drive means for swinging the four joint link, wherein the plate rest is moved to the first position and the second position by the drive means via the four-joint link.

5. The liquid coating machine according to claim 1, wherein a pair of plate bearers having inclined surfaces opposing each other are integrally formed on an upper surface of the ink pan, and the stencil printing plate is supported on the inclined surfaces of the plate bearers.

6. The liquid coating machine according to claim 1, wherein a pair of plate bearers having a plurality of rolling bodies annexed thereto are integrally formed on an upper surface of the ink pan, and the stencil printing plate is supported by the rolling bodies of the plate bearers.

* * * * *